US009146505B2

(12) United States Patent
Yamashita et al.

(10) Patent No.: US 9,146,505 B2
(45) Date of Patent: Sep. 29, 2015

(54) IMAGE FORMING APPARATUS

(71) Applicants: Takeshi Yamashita, Osaka (JP); Yasuhiro Fujiwara, Osaka (JP)

(72) Inventors: Takeshi Yamashita, Osaka (JP); Yasuhiro Fujiwara, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/317,757

(22) Filed: Jun. 27, 2014

(65) Prior Publication Data

US 2015/0003852 A1 Jan. 1, 2015

(30) Foreign Application Priority Data

Jun. 28, 2013 (JP) ..... 2013-137488
May 20, 2014 (JP) ..... 2014-104738

(51) Int. Cl.
*G03G 15/16* (2006.01)

(52) U.S. Cl.
CPC ..... *G03G 15/1605* (2013.01)

(58) Field of Classification Search
None
See application file for complete search history.

(56) References Cited

U.S. PATENT DOCUMENTS 5,697,013 A * 12/1997 Sasaki ..... 399/55
2013/0266332 A1 10/2013 Miyazaki et al.

FOREIGN PATENT DOCUMENTS

JP 7-121081 5/1995
JP 8-234646 9/1996
JP 2013-218029 10/2013

* cited by examiner

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

An image forming apparatus includes a photosensitive member, a charging device, an exposure device, a development device, a transfer device, a first driving device, a voltage application device, and a controller. The first driving device rotatably drives one of the photosensitive member and a combination of the photosensitive member and an intermediate transfer member. The voltage application device supplies a respective predetermined voltage to the charging device, the development device, and the transfer device. The controller controls the first driving device and the voltage application device. When the photosensitive member is stopped, both illumination from the exposure device and the transfer electrical field electrically discharge the surface of the photosensitive member.

19 Claims, 12 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application Nos. 2013-137488, filed on Jun. 28, 2013, and 2014-104738, filed on May 20, 2014, both in the Japan Patent Office, which are hereby incorporated herein by reference in their entirety.

BACKGROUND

1. Technical Field

Exemplary aspects of the present disclosure generally relate to an image forming apparatus, such as a copier, a facsimile machine, a printer, or a plotter, and more particularly, to an image forming apparatus including a photosensitive member on which an electrophotographic process is performed to form an image on a recording medium.

2. Description of the Related Art

In a known electrophotographic image forming apparatus, first, a document reader reads a document image, and subsequently, an electrostatic latent image bearing member of an image forming section is illuminated with light in accordance with the document image. Furthermore, the electrostatic latent image is developed with toner, thereby forming a visible image, known as a toner image. The toner image is transferred onto various kinds of recording media such as paper delivered from a sheet supply section. The transferred toner image is fixed on a recording medium and discharged onto an output section of the image forming apparatus.

The image forming section of the image forming apparatus employs an electrophotographic method using a negative-charge toner, a negative-charge photosensitive member, and an intermediate transfer member.

In such an image forming section of the image forming apparatus, when initializing operations such as a printing operation, a development section is supplied with a voltage (positive voltage) opposite that of the original voltage in order to prevent formation of a magnetic brush which is a cluster of developer formed in a form of brush until the charged portion (negative charge) of the photosensitive member arrives at the development section. After the charged portion of the photosensitive member arrives at the development section, generally, the development section is supplied with the original voltage (negative voltage).

In order to keep the surface potential of the photosensitive member around zero (0) V until the charged portion of the photosensitive member arrives at the development section, generally, the surface potential of the photosensitive member is electrically discharged in advance before stopping driving of the printing operation or the like. Thus, if the surface potential (negative) of the photosensitive member is relatively high at start of driving, the difference in the potential (development potential) between the photosensitive member and the development is significant at start of driving (development section, positive), worsening contamination of a non-image formation area also known as background fogging of the photosensitive member and hence causing unnecessary consumption of developing agent.

In order to reduce the size of the apparatus, it is necessary to reduce the width of an image forming unit as much as possible, and it is known that reducing the width of an exposure device such as a light emitting diode (LED) and a laser diode (LD) shorter than the width of the photosensitive member can reduce the width of the image forming unit. If the exposure width of the LED and LD serving also as a charge remover that electrically discharges the photosensitive member is narrower than the width of the photosensitive member, the edge of the photosensitive member is not electrically discharged. That is, the surface potential of the photosensitive member remains negatively charged. As a result, the potential difference (development potential) between the photosensitive member and the development is significant, worsening the background fogging or contamination of the non-image formation area of the photosensitive drum and hence causing unnecessary consumption of developing agent.

Consequently, the developing agent developed on the photosensitive member adheres to a secondary transfer roller via the intermediate transfer member, contaminating the back surface of the recording medium during the image forming operation on the recording medium. In order to avoid such difficulty, the width of the LED and the LD serving as the charge remover may have a width equal to or greater than the width of the photosensitive member. However, this configuration increases the cost and the space.

JP-3457083-B2 (JP-H08-234646-A) proposes ways in which the charge remover for the photosensitive member is controlled to suppress adherence of the developing agent onto a boundary between the non-exposure portion and the exposed portion (discharged portion) of the photosensitive member. The charge remover maintains an area in which a potential distribution changes gradually between the last discharge potential and a uniform charge potential. When the area enters a development process, a development bias is turned off.

JP-2013-218029-A proposes reducing the intensity of the transfer electrical field less than that during image transfer, when a non-charged surface of the photosensitive member (or a discharged surface) passes by the transfer position, thereby preventing unnecessary charging of the surface of the photosensitive member.

In JP-3457083-B2 (JP-H08-234646-A), adherence of developing agent to the photosensitive member is suppressed by preventing the potential difference from changing sharply at the boundary between the non-exposure portion and the exposed portion (discharged portion) of the photosensitive member when stopping driving of the photosensitive member.

In this configuration, adherence of the developing agent may be suppressed by discharging the photosensitive member when the photosensitive member is stopped. However, the size and the cost are still not reduced because the charge remover is disposed downstream from a primary transfer side of the photosensitive member.

In JP-2013-218029-A, when the non-charged surface of the photosensitive member faces transfer position, the intensity of the transfer electrical field is reduced less than that during image transfer. In other words, JP-2013-218029-A does not propose discharging the photosensitive member by intensifying the transfer electrical field of the transfer section.

In view of the above, there is demand for a charge removing mechanism to prevent contamination of the photosensitive member at a position outside the exposure portion with a width corresponding to the LED width while reducing the size and the cost.

SUMMARY

In view of the foregoing, in an aspect of this disclosure, there is provided a novel image forming apparatus including a photosensitive member, a charging device, an exposure device, a development device, a transfer device, a first driving device, a voltage application device, and a controller. The photosensitive member bears an electrostatic latent image on a surface thereof. The charging device applies a charging bias to the surface of the photosensitive member to uniformly charge the surface thereof. The exposure device illuminates the surface of the photosensitive member to form the electrostatic latent image, and is disposed downstream from the charging device in a direction of rotation of the photosensitive member. The development device develops with a development bias the electrostatic latent image using a development agent to form a toner image and is disposed downstream from the exposure device in the direction of rotation of the photosensitive member. The transfer device transfers the toner image from the photosensitive member onto one of an intermediate transfer member and a recording medium by a transfer electrical field, and is disposed downstream from the development device in the direction of rotation of the photosensitive member. The first driving device rotatably drives one of the photosensitive member and a combination of the photosensitive member and the intermediate transfer member. The voltage application device supplies a respective predetermined voltage to the charging device, the development device, and the transfer device. The controller controls the first driving device and the voltage application device. Both illumination from the exposure device and the transfer electrical field discharge the surface of the photosensitive member when the photosensitive member is stopped.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
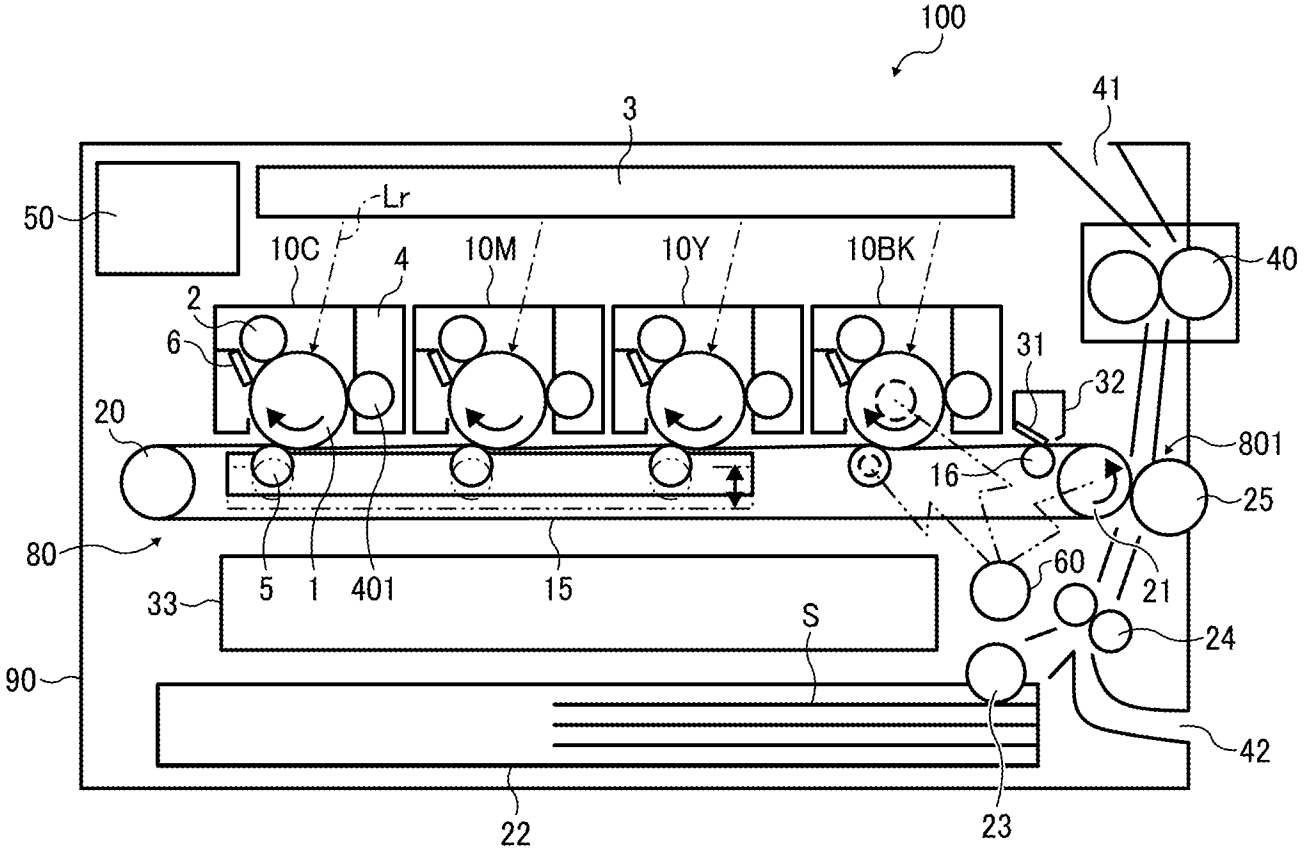
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an image forming apparatus according to an illustrative embodiment of the present disclosure.

The present disclosure relates to an image forming apparatus in which a photosensitive member is driven in accordance with an electrostatic photographic process including charging, exposure, development, and transfer.

That is, when stopping the photosensitive member, an exposure device serving as a latent image forming device projects light to electrically discharge the photosensitive member and also to electrically discharge a transfer electrical field of a transfer device. In other words, according to an illustrative embodiment of the present disclosure, the photosensitive member is prevented from getting charged undesirably without a designated charge remover, thereby allowing cost reduction and suppressing wasteful consumption of the developing agent. Furthermore, this configuration enhances the product life cycles of the photosensitive member and the image forming apparatus.

As illustrated in FIG. 1, an image forming apparatus 100 is equipped with a main body 90 and a controller 50 disposed inside the main body 90. The image forming apparatus 100 shown in FIG. 1 is an example of a color laser printer. The controller 50 receives image data from external devices such as a personal computer, and a facsimile, and a scanner of other image forming apparatuses. In accordance with the image data, the image forming apparatus reads a gradation data for each color. The image forming apparatus 100 includes an image forming unit 80 as an image forming section that performs various imaging and printing operations in accordance with the gradation data.

As illustrated in FIG. 1, the image forming unit 80 is disposed substantially at the center of the main body 90 of the image forming apparatus 100. Four process units 10Bk, 10Y, 10M, and 10C constitute the image forming unit 80 and are detachably attachable relative to the main body 90. The process units 10Bk, 10Y, 10M, and 10C are arranged in series in a flat area above an intermediate transfer belt (an intermediate transfer member) 15 as an image bearing member formed into an endless loop.

The intermediate transfer belt 15 is entrained around and stretched taut between a secondary-transfer opposing roller (hereinafter referred to simply as a transfer drive roller) 21 serving also as a transfer drive roller rotated in a clockwise direction, a cleaning opposing roller 16, a primary transfer roller 5, and a tension roller 20. The transfer drive roller 21 is driven to rotate by a drive motor 60 as a driving device, thereby enabling the intermediate transfer belt 15 and other rollers to rotate. The transfer drive roller 21 is disposed opposite to a secondary transfer roller 25 via the intermediate transfer belt 15 such that the transfer drive roller 21 is contactable relative to the secondary transfer roller 25, thereby constituting a secondary transfer device 801.

As illustrated in FIG. 1, the four process units 10Bk, 10Y, 10M, and 10C, one for each of the colors black, yellow, magenta, and cyan, arranged in tandem substantially above the intermediate transfer belt 15 store the respective color of toner. It is to be noted that the suffixes Bk, Y, M, and C denote colors black, yellow, magenta, and cyan, respectively, and to simplify the description, the suffixes Bk, Y, M, and C indicating colors are omitted herein unless differentiation is necessary. The process units 10Bk, 10Y, 10M, and 10C may be referred to simply as a process unit 10 without suffixes indicating colors unless differentiation of the color is necessary. The four process units 10Bk, 10Y, 10M, and 10C arranged in tandem form visible images in black, yellow, magenta, and cyan, respectively, upon forming a full color image. These visible images are transferred one atop the other onto the intermediate transfer belt 15, thereby forming a full color image.

Each of the process units 10 includes a photosensitive member 1 serving as a latent image bearing member, a charging roller 2 serving as a charging device, a development device 4, a cleaning device, and so forth. The charging roller 2 charges the surface of the photosensitive member 1. The development device 4 develops a latent image on the photosensitive member 1 with toner. The cleaning device includes a cleaning blade 6. The cleaning blade 6 faces the surface of the photosensitive member 1 at a certain angle such that the leading edge of the cleaning blade 6 faces counter to the direction of rotation of the photosensitive member 1 or faces against the downstream side of the photosensitive member 1 in the direction of rotation thereof. The process units 10Bk, 10Y, 10M, and 10C all have the same configuration, differing only in the color of toner employed. Thus, the suffixes indicating the colors are omitted in FIG. 1.

According to the present illustrative embodiment, the photosensitive member 1 is comprised of a cylindrical drum with a diameter $\phi$ of 30 and rotates at a peripheral speed in a range of from 50 mm/s to 200 mm/s. The charging roller 2 pressingly contacts the surface of the photosensitive member 1 so that the charging roller 1 moves together with rotation of the photosensitive member 1. A high-voltage charging device 76 applies to the charging roller 2 a bias consisting of a direct current (DC) voltage or an alternating current (AC) voltage superimposed on a direct current (DC) voltage, thereby charging uniformly the photosensitive member 1 at a surface potential of −500 V or the like.

Subsequently, the photosensitive member 1 is illuminated with an exposure light Lr projected from the exposure device 3 as a latent-image forming device at an exposure position downstream from the charging roller 2 in the direction of rotation of the photosensitive member 1. Accordingly, an electrostatic latent image is formed on the surface of the photosensitive member 1. The photosensitive member is exposed by a laser beam scanner using a laser diode, an LED, and the like. Consequently, the surface potential of the exposed portion of the photosensitive member 1 drops to approximately −50 V or the like.

The development device 4 is disposed downstream from the exposure position in the direction of rotation of the photosensitive member 1. The development device 4 is a single-component, contact-type development device and develops the electrostatic latent image on the photosensitive member 1 into a visible image as a toner image with a predetermined bias of −200 V or the like supplied from a high-voltage power source. The development device 4 stores a single-component toner having a negative charge polarity. A description of the toner will be provided later.

The transfer drive roller 21 is driven by the drive motor 60 as a driving device that enables the intermediate transfer belt 15 to rotate. The process unit 10 and the transfer drive roller 21 may be driven by different drive sources or a common drive source. Generally, at least the process unit 10Bk for the black color and the transfer drive roller 21 are turned on and off simultaneously. Thus, it is desirable that the process unit 10Bk for the black color and the transfer drive roller 21 be driven by the same drive source, hence reducing the size and the cost of the image forming apparatus. Both ends of the tension roller 20 as an intermediate transfer belt stretch mechanism are pressed by a spring.

A cleaning unit 32 including a cleaning blade 31 as a cleaning member is disposed downstream from the secondary transfer device 801 in the direction of rotation of the intermediate transfer belt 15. The cleaning blade 31 cleans the surface of the intermediate transfer belt 15. The cleaning blade 31 of the cleaning unit 32 is a rubber blade, which faces the intermediate transfer belt 15 at a certain angle such that the leading edge of the cleaning blade 31 faces counter to the direction of rotation of the intermediate transfer belt 15. The cleaning blade 31 removes residual toner (development agent) remaining on the intermediate transfer belt 15 after transfer.

As described above, the residual developing agent not having been transferred onto a recording medium at the secondary transfer device 801, thus remaining on the intermediate transfer belt 15, is removed at a position downstream from the secondary transfer device 801. Accordingly, the intermediate transfer belt 15 can be used always in a desired condition. Furthermore, because the cleaning member or the cleaning blade 31 is made of a rubber blade, cleaning can be performed with a simple configuration, allowing downsizing and cost reduction of the image forming apparatus.

Toner employed in the present illustrative embodiment, which will be described later in detail, may be toner in which silica containing oil is used as an external additive. In this case, the external additive with high lubricating properties that facilitates formation of a dam layer at a blade edge portion of the cleaning blade 31 is added to the toner. With this configuration, cleaning ability using a blade is enhanced, and the product life cycles of the intermediate transfer belt 15 (intermediate transfer member) and the image forming apparatus can be extended.

Alternatively, the cleaning unit 32 may employ an electrostatic cleaning method using an electrostatic brush and an electrostatic roller. In the electrostatic cleaning method, a bias is applied to a cleaning brush or a roller, instead of the cleaning blade 31. However, depending on a current status of the use of the image forming apparatus, there is a case in which precharging of the residual toner remaining after transfer may be necessary. In this case, the size of the cleaning unit itself increases. Furthermore, there is a drawback in this configuration in that one to two systems are added to the high-voltage power source, an extra operation is needed to perform bias cleaning, and so forth. In terms of downsizing, cost reduction, and cleanability, cleaning using a blade (blade-cleaning) is preferred.

The residual toner removed by the cleaning blade 31 is delivered to a waste toner storage unit 33 along a toner delivery path.

The primary transfer roller 5 is disposed opposite to each of the photosensitive members 1 of the process units 10, via the intermediate transfer belt 15.

The primary transfer roller 5 as a primary transfer device that applies a transfer electrical field is comprised of a sponge roller having a diameter ϕ in a range of from 12 to 16. The primary transfer roller 5 is enabled to apply a primary transfer bias as a predetermined primary transfer electrical field in a range of from +100 V to +2000 V by an independent high-voltage power source, thereby transferring the toner image from the photosensitive member 1 onto the intermediate transfer belt 15. The primary transfer roller 5 employs an ion-conductive roller (for example, urethane with carbon dispersed therein, nitrile butadiene (NBR), and hydrin rubber) with a resistance adjusted in a range of from 10ˆ6Ω to 10ˆ8Ω, an electron-conductive type roller (EPDM), and so forth.

The intermediate transfer belt 15 serving as an image bearing member is formed into an endless loop and faces the four process units 10 of the image forming unit 80. The intermediate transfer belt 15 employs an endless belt made of a resin film. Examples of materials used for the intermediate transfer belt 15 include, but are not limited to polyvinylidene fluoride (PVDF), ethylene tetrafluoroethylene (ETFE), polyimide (PI), polycarbonate (PC), thermoplastic elastomers (TPE) and so forth, with conductive material such as carbon black dispersed therein.

According to the illustrative embodiment, as the intermediate transfer belt 15, for example, a single-layer belt made of thermoplastic elastomer (TPE) having a tensile elastic modulus in a range of from 1000 MPa to 2000 Mpa with carbon black dispersed therein is used. The thickness thereof is in a range of from 90 μm to 160 μm and a width is approximately 230 mm. As an electrical resistance, in accordance with changes in ambient conditions, the volume resistivity of the intermediate transfer belt 15 is in a range of from 10ˆ8 Ω·cm to 10ˆ11 Ω·cm, and the surface resistivity is in a range of from 10ˆ8 Ω/sq to 10ˆ11 Ω/sq. The volume resistivity and the surface resistivity are measured by Hiresta UPMCP-HT450 manufactured by Mitsubishi Chemical, Ltd with an applied voltage of 500V applied for a period of ten seconds.

The secondary transfer roller 25 facing the transfer drive roller 21 at the secondary transfer position is a sponge roller with a diameter ϕ in a range of from 16 to 25 and employs an ion-conductive roller (e.g., urethane with carbon dispersed therein, nitrile butadiene (NBR), and hydrin rubber) with a resistance adjusted in a range of from 10ˆ6Ω to 10ˆ8Ω, an electron-conductive type roller (EPDM), and so forth. If the electrical resistance of the secondary transfer roller 25 exceeds the above range, electrical current is difficult to flow. Consequently, a higher voltage needs to be applied to obtain necessary transferability, hence increasing the cost of the power source. Furthermore, because the high voltage needs to be applied, electrical discharge occurs in a space before and after the transfer nip of the transfer device. As a result, white void areas are generated in a halftone image. This phenomenon is more pronounced in a low-temperature, low-humidity environment (for example, 10° C., 15% RH).

By contrast, if the electrical resistance of the secondary transfer roller 25 drops below the above-described range, transferability in a multiple-color portion (for example, a portion of an image formed by three colors superimposed one atop the other) and transferability in a single-color portion are not achieved on the same image. This is because when transferring a portion of an image formed with a single color (hereinafter referred to as a single-color image portion), a sufficient amount of current flows with a relatively low voltage. However, when transferring a portion of an image formed with multiple colors (hereinafter referred to as a multiple-color image portion), a voltage higher than an optimum voltage for the single-color image portion is necessary. This means that if the voltage is set to a level capable of transferring the multiple-color image portion, the transfer current is excessive at the single-color image portion, causing degradation of the transfer efficiency.

The resistance value of the primary transfer roller 5 and the secondary transfer roller 25 is measured such that the secondary transfer roller 25 is placed on a conductive metal plate and a load of 4.9 N is applied to each end of the metal core of the secondary transfer roller 25. The resistance value is then calculated based on a current that flows when a voltage of 1 kV is supplied between the metal core and the metal plate.

The transfer drive roller 21 at the secondary transfer position may employ a roller with polyurethane rubber having a thickness in a range of from 0.3 mm to 1 mm, a roller coated with a thin layer having a thickness in a range of from 0.03 mm to 0.1 mm, and the like. According to the present illustrative embodiment, a roller coated with urethane having a thickness in a range of from 0.05 mm and a diameter ϕ of 19 is employed since changes in the diameter is small when the temperature changes. The electrical resistance of the transfer drive roller 21 is set to a lower level than that of the secondary transfer roller 25. More specifically, the electrical resistance of the transfer drive roller 21 is set to a level equal to or less than 10^6Ω.

A recording medium S is placed on a sheet cassette 22 or in a manual feed opening 42. A sheet conveyor roller 23, a pair of registration rollers 24, and so forth feed the recording medium S to the secondary transfer position in appropriate timing such that the leading end of the toner image on the intermediate transfer belt 15 arrives at the secondary transfer position. Subsequently, a predetermined secondary transfer bias is applied to the secondary transfer roller by the high-voltage power source, thereby transferring the toner image from the intermediate transfer belt 15 to the recording medium S. In this configuration, the recording medium S is fed vertically. The recording medium S separates from the intermediate transfer belt 15 due to the curve of the secondary transfer drive roller 21, and the toner image transferred onto the recording medium S is fixed by a fixing device 40 which applies heat and pressure to the toner image on the recording medium S. After the toner image is fixed on the recording medium S, the recording medium S is discharged from a sheet output opening 41.

A positive (+) bias is applied as a secondary transfer bias to the secondary transfer roller 25 while the transfer drive roller 21 is electrically grounded. In this configuration, an attraction transfer method in which a secondary transfer electrical field is formed can be applied. By contrast, in a configuration in which a negative (−) bias is applied to the transfer drive roller 21 and the secondary transfer roller 25 is electrically grounded, a repulsive transfer method to form a secondary transfer electrical field can be applied. As described above, there are two known transfer methods. In the present illustrative embodiment, the attraction transfer method is employed and a current in a range of from +5 μA to 100 μA is applied as a transfer bias when the recording medium S passes through the secondary transfer position.

Furthermore, an image formation process speed is changed in accordance with a type of the recording medium S (transfer medium). More specifically, in a case in which a recording medium S having the basis weight equal to or greater than 100 g/m^2 is used, the image formation process speed is reduced to half so that it takes for the recording medium S to pass through a fixing nip between a pair of fixing rollers twice as much time as the normal image formation process speed.

A description is provided of toner as a single-component developing agent employed in the present illustrative embodiment.

[Preparation of Polyester 1]

Charge a reaction vessel equipped with a condenser, a stirrer, and a nitrogen inlet pipe with 235 parts of ethylene oxide 2 mol adduct of bisphenol A, 525 parts of propylene oxide 3 mol adduct of bisphenol A, 205 parts of terephthalic acid, 47 parts of adipic acid, and 2 parts of dibutyltin oxide. Subject the mixture to a reaction for 8 hours at 230° C. under normal pressure and subsequent 5 hours under reduced pressures of 10 to 15 mmHg. After adding 46 parts of trimellitic anhydride, further subject the mixture to a reaction for 2 hours at 180° C. under normal pressure. Thus, polyester 1 is prepared. The polyester 1 has a number average molecular weight of 2600, a weight average molecular weight of 6900, a glass transition temperature (Tg) of 44° C., and an acid value of 26 mgKOH/g.

[Preparation of Prepolymer 1]

Charge a reaction vessel equipped with a condenser, a stirrer, and a nitrogen inlet pipe with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. Subject the mixture to a reaction for 8 hours at 230° C. under normal pressure and subsequent 5 hours under reduced pressures of 10 to 15 mmHg. Thus, an intermediate polyester 1 is prepared. The intermediate polyester 1 has a number average molecular weight of 2100, a weight average molecular weight of 9500, a glass transition temperature (Tg) of 55° C., an acid value of 0.5 mgKOH/g, and a hydroxyl value of 49 mgKOH/g.

Charge another reaction vessel equipped with a condenser, a stirrer, and a nitrogen inlet pipe with 411 parts of the intermediate polyester, 89 parts of isophorone diisocyanate, and 500 parts of ethyl acetate. Subject the mixture to a reaction for 5 hours at 100° C. Thus, prepolymer 1 is prepared. The prepolymer 1 includes 1.53% of free isocyanates.

[Preparation of Master Batch 1]

Mix 40 parts of carbon black (REGAL 400R manufactured by Cabot Corporation), binder resin: 60 parts of polyester resin (RS801 from Sanyo Chemical Industries, Ltd., acid value 10, Mw2000, glass transition temperature (Tg) of 64° C.), and 30 parts of water using a Henschel mixer to attain a mixture of pigment coagulation sopped in water. Knead the resulting mixture by a double roll for 45 minutes at 130° C. Pulverize the mixture into particles of 1 mm by a pulverizer. Thus, a master batch 1 is prepared.

[Preparation of Colorant Wax Dispersion 1]

Charge a reaction vessel equipped with a stirrer and a thermometer with 545 parts of the polyester 1, 181 parts of a paraffin wax, and 1450 parts of ethyl acetate. Heat the mixture to 80° C. while agitating it, keep it at 80° C. for 5 hours, and cool it to 30° C. over a period of one hour. Further, mix 500 parts of the master batch 1, 100 parts of charge control agent, and 100 parts of ethyl acetate in the mixture for one hour.

Thereafter, subject 1500 parts of the resulting mixture to a dispersion treatment using a bead mill (ULTRAVISCOMILL (trademark) from Aimex Co., Ltd.), filled with 80% by volume of zirconia beads having a diameter of 0.5 mm, at a liquid feeding speed of 1 kg/hour and a disc peripheral speed of 6 m/sec. Repeat this dispersing operation three times (three passes). Subsequently, add 425 parts of the polyester 1 and 230 parts thereto, and subject the resulting mixture to the above dispersing operation once (one pass). Thus, a colorant wax dispersion 1 is prepared. Add ethyl acetate to adjust the solid concentration of colorant and wax dispersion 1 to 50% at 130° C. for 30 minutes.

[Preparation of Aqueous Phase]

Mix and agitate 970 parts of ion-exchange water, 40 parts of 25% by weight aqueous dispersion liquid of fine particles of organic resin (i.e., a copolymer of styrene, methacrylic acid, butyl acrylate, and a sodium salt of a sulfate of ethylene oxide adduct of methacrylic acid) for dispersion stability, 140 parts of a 48.5% aqueous solution of dodecyl diphenyl ether sodium disulfonate (ELEMINOL MON-7 from Sanyo Chemical Industries, Ltd.), and 90 parts, thereby attaining milky whitish liquid, which is the aqueous phase.

[Emulsification]

Mix 975 parts of the colorant and wax dispersion 1, 2.6 parts of amine such as isophoronediamine using a TK HOMOMIXER (from Primix Corporation) at a revolution of 5000 rpm for one minute. Subsequently, add 88 parts of the prepolymer 1 and mix using the TK HOMOMIXER (from Primix Corporation) at a revolution of 5000 rpm for one minute. Then, add 1200 parts of the above aqueous phase 1 thereto. Mix the mixture using the TK HOMOMIXER (from Primix Corporation) at a revolution of 8000 to 13000 rpm for 20 minutes, thereby attaining emulsion slurry 1.

[Solvent Removal]

Charge a vessel equipped with a stirrer and a thermometer with the emulsion slurry 1 and subject it to a solvent removal treatment at 30° C. for 8 hours. Thus, dispersion slurry 1 is prepared.

[Washing and Drying]

After filtering 100 parts of the dispersion slurry 1 under reduced pressure, 1) mix the filtration cake with 100 parts of ion-exchange water using a TK HOMOMIXER at a revolution of 12000 rpm for 10 minutes, and then filter the thus-obtained mixture. The filtered liquid is milky whitish. 2) Mix the filtration cake obtained in 1) with 900 parts of ion-exchange water by a TK HOMOMIXER at a revolution of 12000 rpm for 30 minutes, with supersonic vibration and then filter the mixture under reduced pressure. Repeat this process until the degree of electrical conduction of the slurry liquid is 10 μC/cm or lower. 3) Mix the slurry liquid in 2) with a 10% hydrochloric acid to adjust pH of the slurry liquid to 4. Agitate it by a three-one motor for 30 minutes and then filter the mixture. 4) Mix the filtration cake obtained in 3) with 100 parts of hydrochloric acid using the TK HOMOMIXER at a revolution of 12000 rpm for 10 minutes and then filter the mixture. Repeat this process until the degree of electrical conduction of the slurry liquid becomes 10 μC/cm or lower to attain a filtration cake 1.

Dry the filtration cake 1 by a circulating drier at 42° C. for 48 hours and then sieve it with a mesh having openings of 75 μm. Thus, a toner mother particle 101 is prepared. The toner mother particle 101 has an average circularity of 0.974, a volume average particle diameter (Dv) of 6.3 μm, a number average particle diameter (Dp) of 5.3 μm, and a particle diameter distribution (Dv/Dp) of 1.19.

Mix, in a Henschel mixer, 100 parts of the thus-obtained mother particle and 1 part of commercially available silica particle such as H20™ (from Clariant Japan Co., Ltd, having an average primary particle diameter of 12 nm, without silicone oil treatment), and 2 parts of RY50 (from Nippon Aerosil Co., Ltd, having an average primary particle diameter of 40 nm, with silicone oil treatment), and filter the mixture with a sieve having an opening size of 60 μm, thereby removing rough particles or aggregation. Thus, toner, which is a single component developing agent, is produced.

Figure 2:
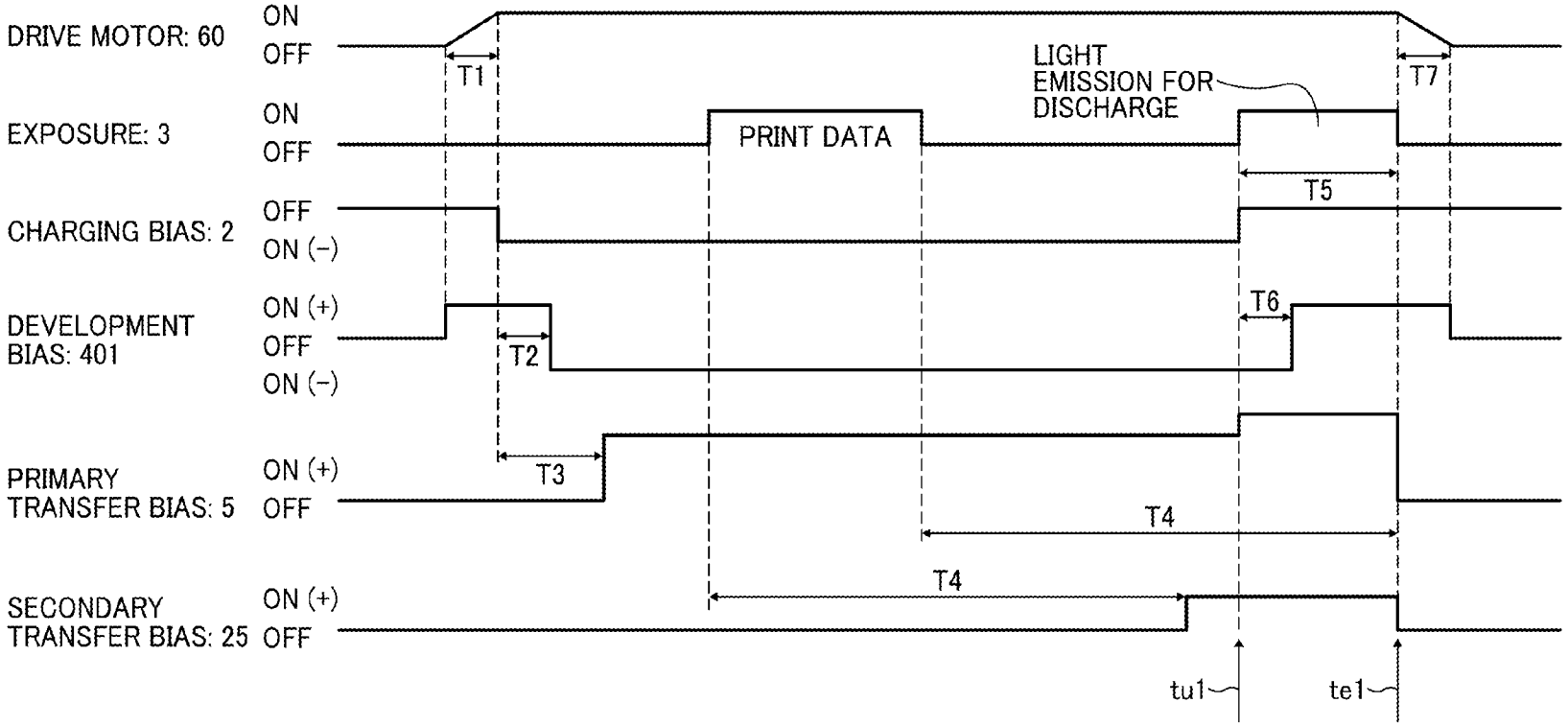
FIG. 2 is a timing diagram showing an operation sequence in a single color mode of the image forming apparatus of FIG. 1.

With reference to FIG. 2, a description is provided of operation of a printer as an example of the image forming apparatus 100 when a printing mode is a single-color (for example, black) printing mode according to a first illustrative embodiment of the present disclosure.

FIG. 2 is a timing diagram showing a sequence of printing in the single color, for example, the black color, controlled by the controller 50.

In the single-color printing mode, only the process unit 10Bk for the color black is driven, and other process units 10 are held in a non-printing state. The primary transfer rollers 5 facing the process units 10 other than the process unit 10Bk are separated from the process units 10 and are held at a retracted position indicated by a double-dot-dash line in FIG. 1 by a moving device. The primary transfer rollers 5 at the retracted position rotate idle. The intermediate transfer belt 15 in this state is stretched at an appropriate tension by the transfer belt stretch mechanism disposed at each end of the tension roller 20.

Figure 3:
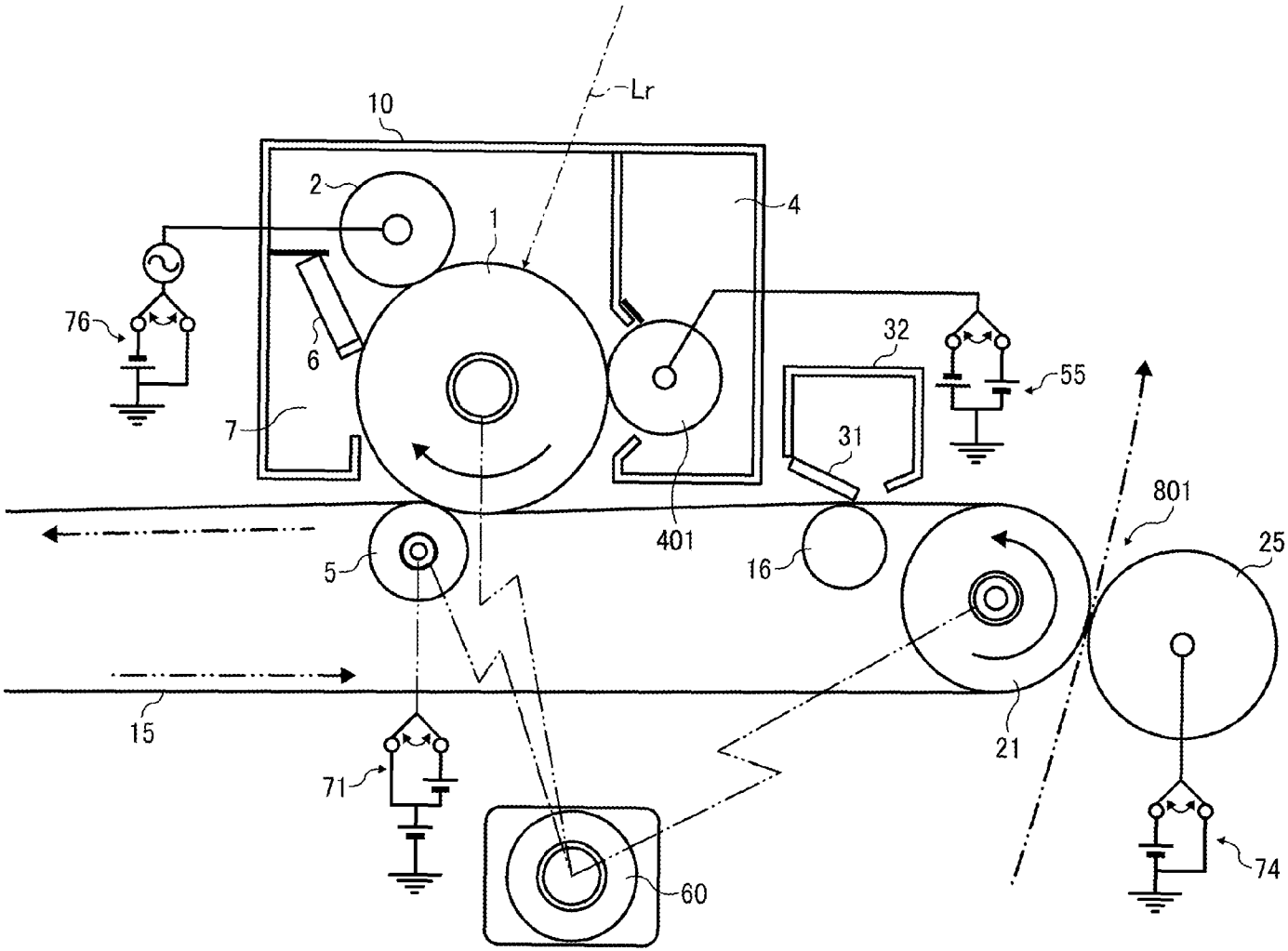
FIG. 3 is an enlarged diagram schematically illustrating a process cartridge for the color black.

FIG. 3 illustrates a partially enlarged diagram schematically illustrating the process unit 10Bk for the black color.

The drive motor 60 shown in FIGS. 1 through 3 is a single commonized driving device for driving the process units 10 including the photosensitive member 1 and for driving the transfer drive roller 21 that rotatably drives the intermediate transfer belt 15. Since the single driving device, that is, the drive motor 60 drives multiple devices including the photosensitive member 1 and the transfer drive roller 21, the number of drive sources can be reduced, thereby reducing the cost and the size of the image forming apparatus.

Figure 12:
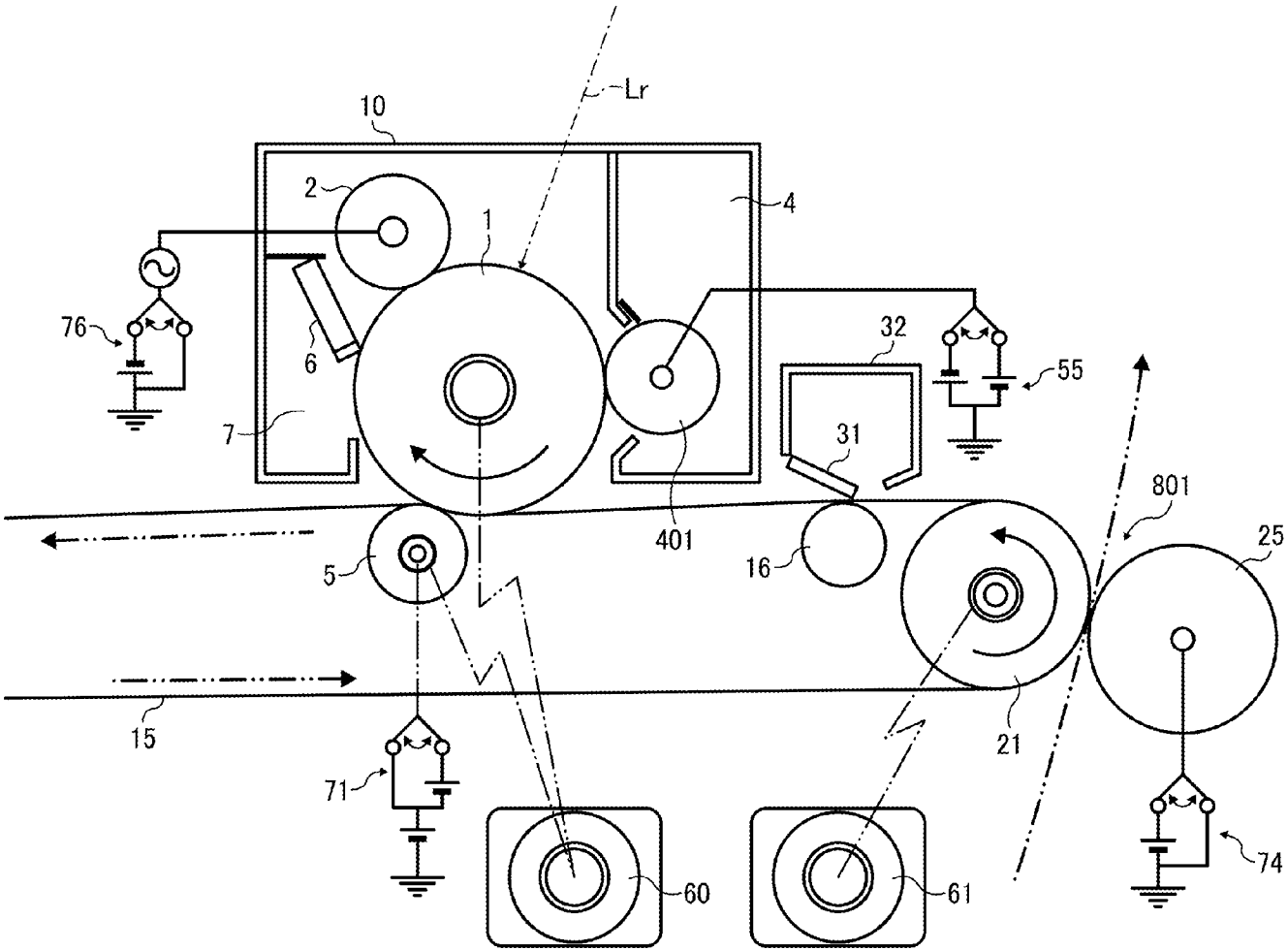
FIG. 12 is an enlarged diagram schematically illustrating the process cartridge for the color black according to another illustrative embodiment of the present disclosure.

Alternatively, as illustrated in FIG. 12, the photosensitive member 1 and the transfer drive roller 21 may be driven by different drive motors. More specifically, the drive motor 60 (first drive motor) may drive the photosensitive member 1, and a second drive motor 61 may drive the transfer drive roller 21.

T1 in FIG. 2 refers to a time from the start of driving the drive motor 60 until rotation thereof is stabilized. T7 refers to a time from when the drive motor 60 starts stopping until the drive motor 60 stops.

Exposure in FIG. 2 includes two kinds of drive timing: light emission against the photosensitive member 1 in accordance with print data and light emission to electrically discharge the photosensitive member 1 to reduce the potential of the surface of the photosensitive member 1 to zero before the photosensitive member 1 stops. As will be described later, the light emission in accordance with the print data is enabled after the primary transfer bias which is a primary transfer electric field at the primary transfer device starts to be output. T5 refers to a time required for the photosensitive member 1 to make one rotation. The light emission for discharge is completed before turning off the output of the secondary transfer bias. This light emission is similar to or the same light emission as when printing in all black. That is, the surface of the photosensitive member is electrically discharged. This light emission for discharge stops when the drive motor 60 starts to stop.

A charge bias in FIG. 2 starts to be output after driving of the drive motor 60 is stabilized (in order to obtain a uniform charge distribution after an elapse of T1). Furthermore, when stopping the photosensitive member 1 and the intermediate transfer belt 15, prior to stopping the photosensitive member 1 and the intermediate transfer belt 15, a charge voltage of the charging roller 2 is turned off in the same timing as the light emission for discharging by the exposure device 3, thereby attaining a potential of zero (lower than that during development, depending on a case). Accordingly, when stopping light emission for discharge (i.e., during T5), wasteful consumption of electrical energy spent on discharging and charging the photosensitive member 1 is prevented.

In a development bias in FIG. 2, a positive (+) output is applied to prevent unnecessary adhesion of developing agent to the photosensitive member 1 simultaneously when the drive motor 60 starts to drive, and the output is switched to a negative (−) output after an elapse of T2 after driving of the drive motor 60 is stabilized. Here, T2 is a required time during which a portion of the photosensitive member 1 that contacts the charging roller 2 arrives at a place of contact with the development device 4.

A primary transfer bias in FIG. 2 is applied to the primary transfer roller 5 by a high-voltage application device 71 (shown in FIG. 3), and starts to be output (for example, +1000 V) after an elapse of T3 after driving of the drive motor 60 is stabilized. Here, T3 is a required time during which a portion of the photosensitive member 1 that contacts the charging roller 2 arrives at a place of contact with the primary transfer roller 5. When the exposure device 3 projects light for discharge, the output is raised. For example, the output of +1200 V (described later with reference to FIG. 4) is output to reliably discharge the non-image (background) portion of the photosensitive member 1, and the output is stopped when the drive motor 60 starts to stop. Accordingly, before the photosensitive member 1 stops, discharging of the image portion and the non-image portion of the photosensitive member 1 is completed.

A secondary transfer bias in FIG. 2 is applied to the secondary transfer roller 25 by a high-voltage application device 74 (shown in FIG. 3), and starts to be output after an elapse of T4 from the start of light emission by the exposure device 3 in accordance with the print data. The output of the secondary transfer bias is stopped after the elapse of T4 after the light emission in accordance with the print data by the exposure device 3 is stopped. Here, T4 is a sum of a required time during which a portion of the photosensitive member 1 illuminated with the exposure light Lr of the exposure device 3 arrives at a place of contact with the primary transfer roller 5 and a required time during which a portion of the intermediate transfer belt 15 that contacts the primary transfer roller 5 arrives at a place of contact with the secondary transfer roller 25.

It is to be noted that the secondary transfer bias may be turned on and off at exposure as described above. Alternatively, the secondary transfer bias may be turned on and off when a recording medium detector disposed near the pair of registration rollers 24 detects a leading edge or a trailing edge of a recording medium S passing by the recording medium detector.

In any event, the photosensitive member 1 starts to be electrically discharged in accordance with the time at which the recording medium S passes through the secondary transfer device 801, and driving of the intermediate transfer belt 15 (the drive motor 60, the photosensitive member 1) is stopped at a time te1 (shown in FIG. 2) after the trailing edge of the recording medium S passes through the secondary transfer device 801. With this configuration, unnecessary driving of the intermediate transfer belt 15 (the drive motor 60, the photosensitive member 1) is suppressed, thereby enhancing the product life cycles of these devices.

Figure 7:
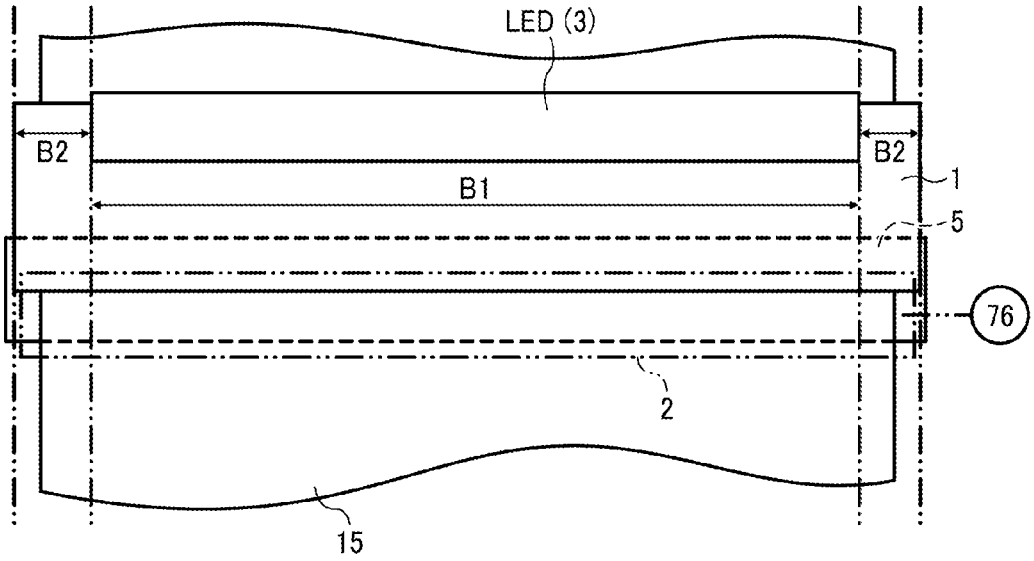
FIG. 7 is a conceptual diagram showing a correlation between a width of the photosensitive member and an exposure portion subjected to exposure by an LED.

According to the first illustrative embodiment, in the image forming apparatus 100 (printer), as illustrated in FIG. 7, an image area B1, which is a portion of the photosensitive member 1 exposed by the LED of the exposure device 3, is narrower in width in the main scanning direction than that of the photosensitive member 1 by 2×B2. B2 is a non-image area at an end portion of the photosensitive member 1 which is not exposed by the LED. In this configuration, prior to stopping the photosensitive member 1 and the intermediate transfer belt 15 (intermediate transfer member), the LED of the exposure device 3 illuminates (exposes) the entire image area B1 to electrically discharge. That is, the surface potential of the image area B1 is reduced to near zero.

Because the high-voltage charging device 76 for the charging roller 2 is driven to apply a negative (−) charge bias to the non-image area B2 at the end portions of the photosensitive member 1, the potential is relatively high, for example, approximately −400 V.

Thus, when stopping the photosensitive member 1 and the intermediate transfer belt 15 (intermediate transfer member), prior to stopping the photosensitive member 1 and the intermediate transfer belt 15, a development voltage application device 55 is driven after an elapse of T6 (shown in FIG. 2) after the exposure device 3 starts to project light to electrically discharge. Then, the polarity of the voltage of the development bias of a development roller 401 is changed to a polarity (i.e., a positive polarity) opposite the normal polarity (i.e., a negative polarity). By reversing the polarity of the development voltage to the polarity opposite that during development, unnecessary development by the development roller 401 is stopped, hence preventing excessive consumption of the developing agent.

Furthermore, the development bias is changed to a positive bias at start. By reversing the polarity of voltage of the development bias to the polarity opposite the normal polarity (i.e., a negative polarity), scattering of toner having a normal charge (−) on the development roller 401 is suppressed, hence preventing undesirable development on the photosensitive member 1.

At start, the non-image area B2 at the end portions of the photosensitive member 1 is not electrically discharged by the LED, and the development potential of the non-image area B2 is relatively large, causing the weakly charged toner or the normal charge toner to transfer to the photosensitive member 1, resulting in background fogging in which the background is tainted by toner.

In view of the above, prior to the time te1 at which rotation of the photosensitive member 1 is stopped, that is, prior to stopping the drive motor 60, the primary transfer bias of the primary transfer roller 5 together with the light emission of LED is used to electrically discharge the photosensitive member 1. More specifically, the output of the primary transfer bias is increased at a time tu1 as shown in FIG. 2 (for example, +1150 V). In accordance with this change, the surface potential of the non-image area B2 of the end portions of the photosensitive member 1 is electrically discharged to a desired value which is a little less than 0V (approximately −400 v). As will be described later, the threshold value (i.e., a little less than 0V) reduces a background potential (i.e., a difference between the potential of the photosensitive member 1 and the development potential) between the non-image are B2 at the end portions of the photosensitive member 1 and the development bias, thereby preventing toner from adhering to the photosensitive member 1.

With this configuration, when starting the drive motor 60 again, that is, at the start of rotation of the photosensitive member 1, the image forming operation can be performed without toner adhering to the image area B1 and the non-image area B2 of the photosensitive member 1, thereby forming an image on the recording medium S without background fogging.

Figure 4:
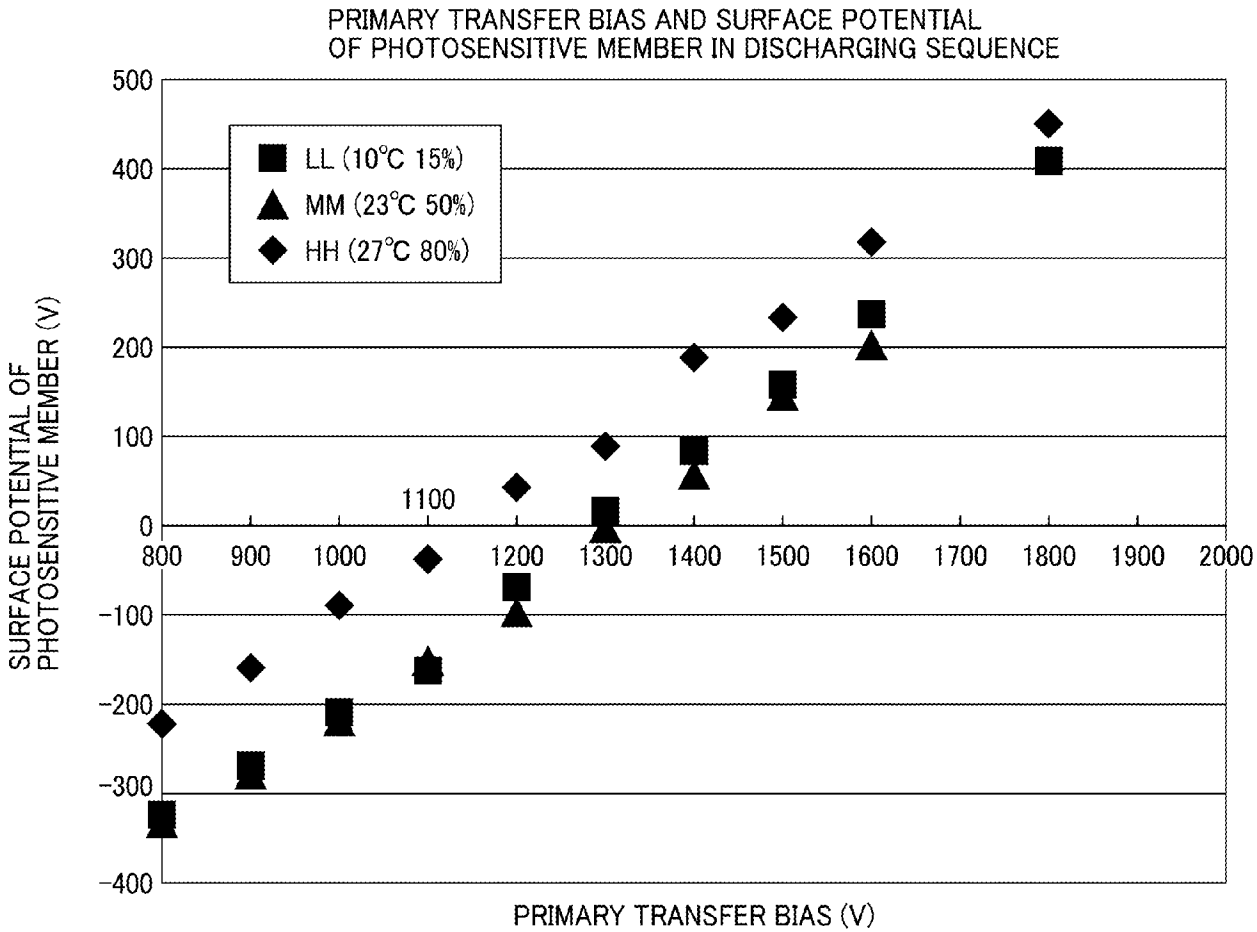
FIG. 4 is a graph showing characteristics of changes in a primary transfer bias and a surface potential of a photosensitive member in a discharging sequence.

With reference to FIG. 4, a description is provided of the threshold value (a little less than 0V).

FIG. 4 is a graph showing characteristics of changes in the primary transfer bias and the surface potential of the photosensitive member 1 under different ambient conditions. It is to be noted that in FIGS. 4, 9 through 11, a horizontal axis represents the primary transfer bias applied to the photosensitive member 1 in a discharging sequence and a vertical axis represents the surface potential (V) of the photosensitive member 1. Here, the discharging sequence refers to a sequence in which the periphery of the photosensitive member 1 is discharged prior to stopping the image forming process.

In FIG. 4, as ambient conditions of the photosensitive member 1, a low-temperature, low-humidity (LL) environment (for example, 10° C., 15% RH) is indicated by ■; a medium-temperature, medium-humidity (MM) environment (for example, 23° C., 50% RH) is indicated by ▲; and a high-temperature, high-humidity (HH) environment (for example, 27° C., 80% RH) is indicated by ◆. FIG. 4 shows that as the ambient conditions change there is a shift in a correlation between the primary transfer bias of the primary transfer roller 5 and the surface potential of the photosensitive member 1 when the image forming operation is not in operation.

As shown in FIG. 4, with an increase in the primary transfer bias, the surface potential of the photosensitive member 1 increases towards the positive (+) side. Furthermore, in the high-temperature, high-humidity environment, when the surface potential of the photosensitive member 1 exceeds a threshold line LVh of a little less than 0V, toner moves from the development roller 401 to the photosensitive member 1, that is, development takes place. If the surface potential of the photosensitive member 1 exceeds 0V and the photosensitive member is left in a positive charged state, an exposure sensitivity of the photosensitive member changes and as a result, a resulting image has unevenness of image density. In view of the above, the primary transfer bias of approximately 1150V, by which the surface potential of the photosensitive member is reduced to a little less than 0V, is applied to the primary transfer roller 5. Accordingly, the photosensitive member 1 is electrically discharged to a little less than 0V without transfer of toner.

In the high-temperature, high-humidity environment, the threshold line LVh without transfer of toner is 0V. In the medium-temperature, medium-humidity environment and in the low-temperature, low-humidity environment, that is, when the temperature and humidity decrease, the charge of toner increases, and the higher is the charge of toner, the more easily the toner is developed relative to a positive potential of the photosensitive member 1. Thus, as compared with the threshold line LVh in the high-temperature, high-humidity environment, in the medium-temperature, medium-humidity environment and in the low-temperature, low-humidity environment, the threshold line LVh shifts to the lower surface potential side of the photosensitive member 1, which results in a decrease in a rage in which toner is not transferred so that the surface of the photosensitive member 1 tends to get developed easily.

Furthermore, one of factors that change an effect of electrical discharge on the photosensitive member 1 is a film thickness of the photosensitive member 1 and a resistance of the intermediate transfer belt 15.

The way in which the surface of the photosensitive member 1 is electrically discharged depends on the film thickness of the photosensitive member 1 and the primary transfer bias of the primary transfer roller 5.

The film thickness of the photosensitive member 1 decreases linearly in accordance with a travel distance of the photosensitive member 1. Thus, the primary transfer bias is controlled (changed) in accordance with the travel distance of the photosensitive member 1.

The travel distance of the photosensitive member 1 is calculated using a time during which the drive motor (i.e., the drive motor 60 which serves as a commonized drive source for the process unit 10) for the photosensitive member 1 rotates.

When applying a particular primary transfer electrical field (transfer bias) to the transfer device by the high-voltage application device 71 to electrically discharge the photosensitive member 1, if the transfer bias is too large, the photosensitive member 1 is positive charged, causing the development roller 401 to eject toner.

In a case in which the film thickness of the surface layer of the photosensitive member is relatively thick, the electrostatic capacitance of a capacitor component of the surface layer of the photosensitive member 1 is small, hindering the photosensitive member 1 from getting charged. By contrast, if the film thickness of the surface layer is relatively thin, the photosensitive member 1 is charged easily. The film thickness of the surface layer of the photosensitive member 1 becomes thinner and thinner as the travel distance of the photosensitive member 1 increases, and thus the photosensitive member 1 becomes easily charged (discharged) over time.

As for the intermediate transfer belt 15, the resistance of the intermediate transfer belt 15 increases proportional to a length of time during which power is supplied to the intermediate transfer belt 15. Because the length of time during which power is supplied and the travel distance of the intermediate transfer belt 15 are proportional to each other, the resistance of the intermediate transfer belt 15 increases as the travel distance increases. As the resistance of the intermediate transfer belt 15 increases, the voltage to be charged to the photosensitive member 1 decreases. As a result, the photosensitive member 1 is difficult to charge (discharge).

Here, the resistance of the intermediate transfer belt 15 increases after extended application of power. Thus, the primary transfer bias is controlled or changed in accordance with the travel distance (a rotation distance) of the intermediate transfer belt 15.

As described above, the film thickness of the photosensitive member 1 or the resistance of the photosensitive member 1 and the intermediate transfer belt 15 changes in accordance with changes in the environment. By changing the transfer bias to be applied to the primary transfer device by the high-voltage application device 71, the surface potential of the photosensitive member 1 attains a proper potential, hence preventing undesirable adherence of toner to the photosensitive member 1.

The travel distance of the intermediate transfer belt 15 can be calculated easily using the number of rotation of the drive motor for the intermediate transfer belt 15 and the number of rotation of the drive motor for the photosensitive member 1.

In the image forming apparatus 100 of the first illustrative embodiment, when the controller 50 stops the photosensitive member 1, before the controller 50 stops the photosensitive member 1, the exposure device 3 illuminates and exposes entirely the image area B1 of the photosensitive member 1 to electrically discharge the photosensitive member 1. That is, the surface potential of the image area B1 is reduced to near zero. The non-image area B2 at each end portion of the photosensitive member 1, which is not exposed by the LED, is electrically discharged by the transfer electric field of the primary transfer roller 5. With this configuration, consumption of the developing agent is suppressed with a relatively low-cost configuration, and the product life cycles of the photosensitive member 1 and the image forming apparatus 100 are enhanced.

Furthermore, when the controller 50 stops the photosensitive member 1 and the intermediate transfer belt 15 (an intermediate transfer member), the exposure device 3 illuminates the surface of the photosensitive member 1 to electrically discharge the surface thereof while using the transfer electric field of the primary transfer roller 5 (primary transfer device) to electrically discharge the entire area of photosensitive member 1 in the main scanning direction. With this configuration, consumption of the developing agent is suppressed with a relatively low-cost configuration, and the product life cycles of the photosensitive member 1 and the image forming apparatus 100 are enhanced.

In the first illustrative embodiment shown in FIG. 2, the image forming apparatus 100 of is in the single-color mode, for example, printing in black, and the time at which the output of the secondary transfer bias is stopped and the time at which the drive motor 60 stops coincide.

Figure 5:
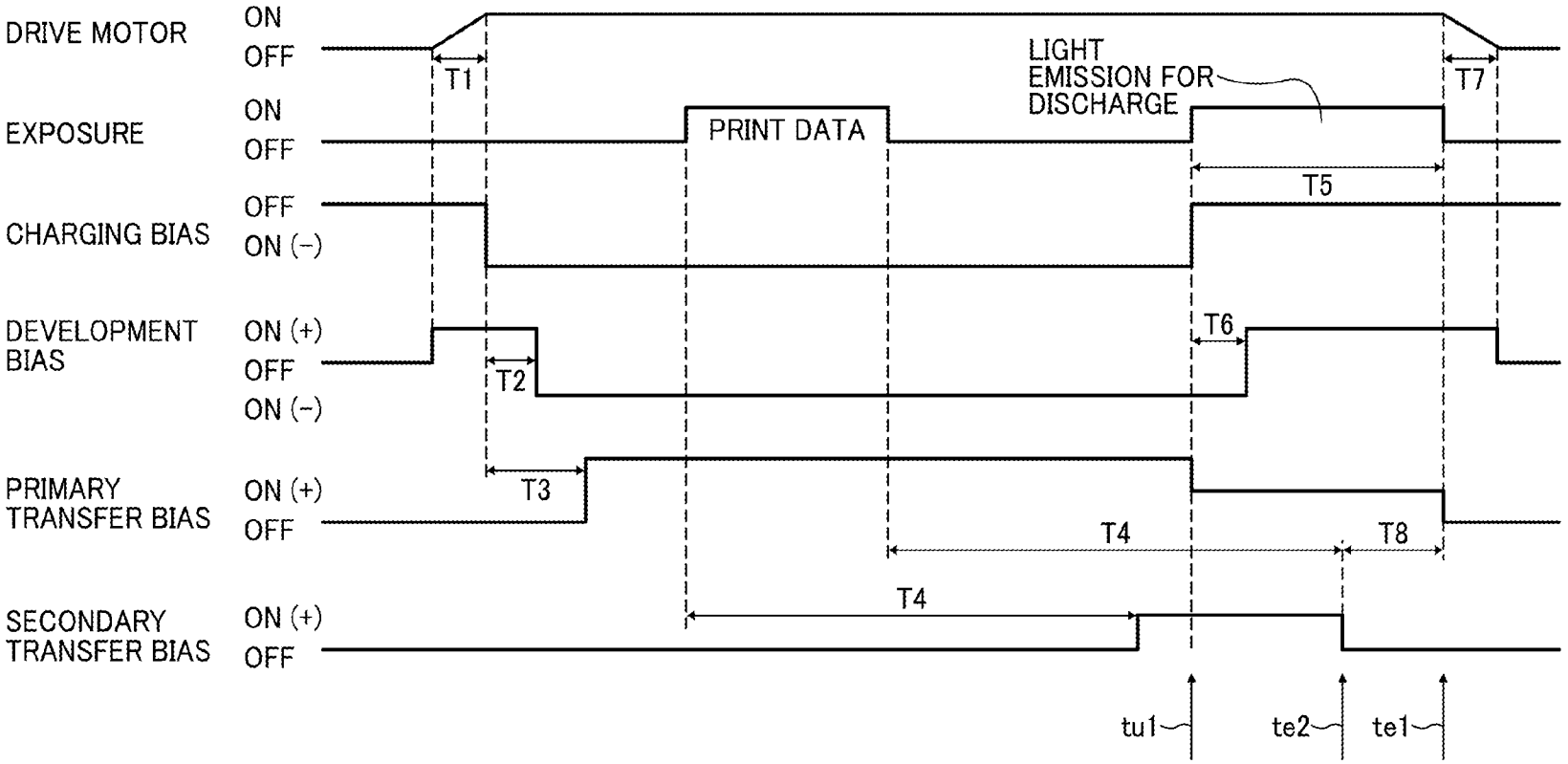
FIG. 5 is a timing diagram showing a variation of the operation sequence of the image forming apparatus.

By contrast, FIG. 5 illustrates a variation of a timing diagram in which the time at which the output of the secondary transfer bias is stopped and the time at which the drive motor 60 stops do not coincide with each other.

More specifically, FIGS. 5 and 2 show a single-color printing operation sequence (for example, the color black). In FIG. 5, the time te1 at which the drive motor 60 is stopped is delayed from a time te2 at which the secondary transfer bias output is stopped.

After the secondary transfer bias output is stopped, that is, after a time T8, the drive motor 60 starts to be stopped when the light emission of the exposure device 3 for discharge is stopped. The length of the time T8 is set to approximately 0.1 sec in consideration of variations in transport time of the recording medium S. In this configuration, unnecessary driving is prevented, thereby enhancing durability and the product life cycles of devices.

Furthermore, the drive motor 60, which is a commonized driving device commonized with the driving device for the photosensitive member 1 of the process unit 10 and the second drive motor 61 for the transfer drive roller 21, also drives the fixing device 40.

Using the common driving device (i.e., the drive motor 60), the drive motor 60 is stopped when the trailing edge of the recording medium S passes through the secondary transfer device 801, and after passing through the fixing device 40 the drive motor 60 is stopped so that the stop timing is the same. With this configuration, structures of rotation-drive systems of the process unit 10 and the intermediate transfer belt 15 are concentrated, thereby reducing cost and stopping unnecessary driving. In this regard, the durability and the product life cycle of the devices can be enhanced as well.

Figure 6:
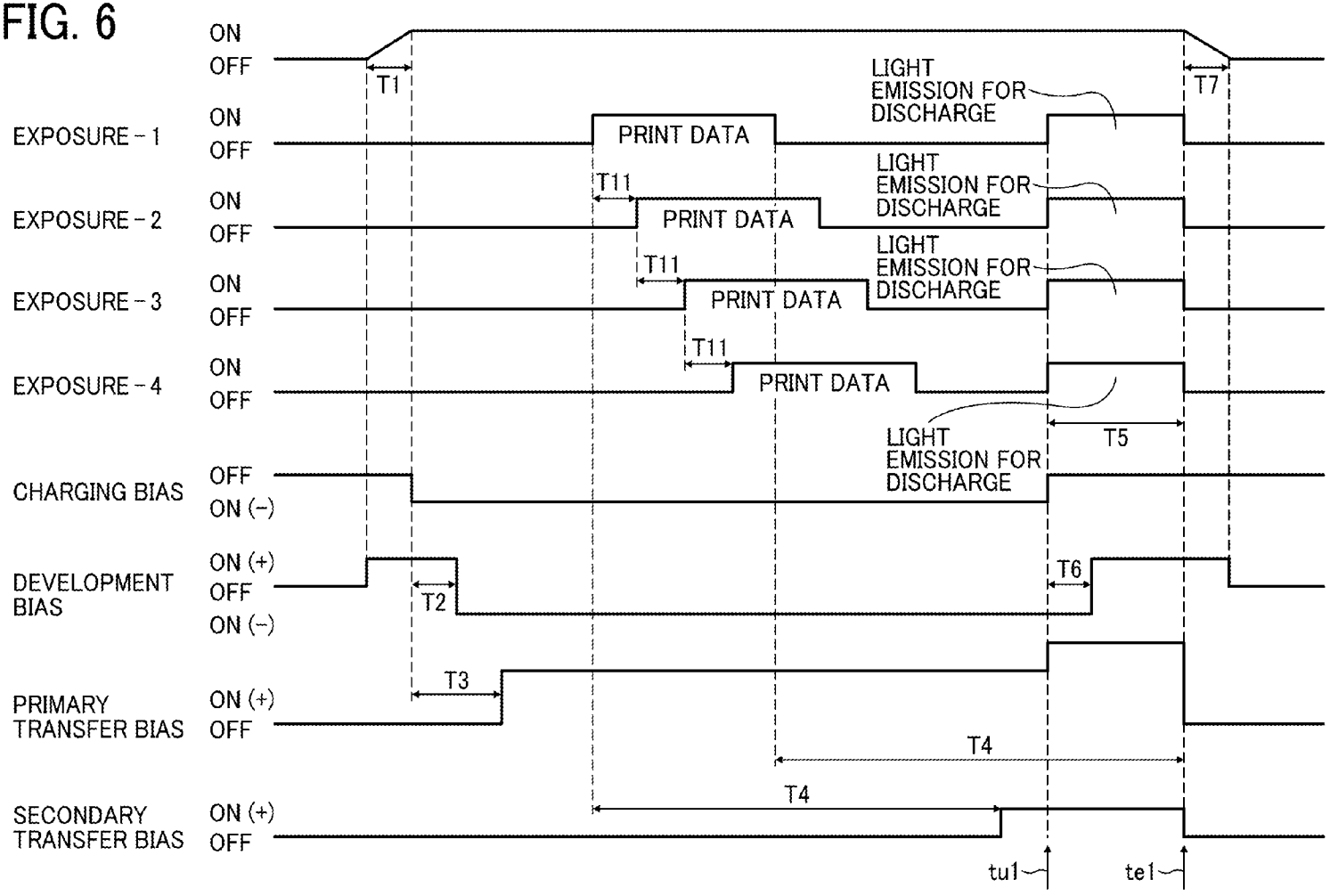
FIG. 6 is a timing diagram showing an operation sequence in a full color mode of the image forming apparatus according to an illustrative embodiment of the present disclosure.

With reference to FIG. 6, a description is provided of a second illustrative embodiment of the present disclosure. According to the second illustrative embodiment, the image forming apparatus 100 (printer) operates as a full-color printer for full-color printing. FIG. 6 is a timing diagram showing a sequence of the full-color printing.

In the present illustrative embodiment, the drive motor 60 is a commonized driving device commonized with the first driving device for driving the process units 10 including the photosensitive member 1 and the second drive motor 61 for driving the transfer drive roller 21 that rotatably drives the intermediate transfer belt 15.

T1 in FIG. 6 refers to the time from the start of driving the drive motor 60 until rotation thereof is stabilized. T7 refers to a time from when the drive motor 60 starts stopping until the drive motor 60 stops completely.

In the full-color printing mode, all of four process units 10Bk, 10Y, 10M, and 10C above the intermediate transfer belt 15 are driven, and four primary transfer rollers 5 opposite to the process units 10Bk, 10Y, 10M, and 10C are held at the drive position indicated by the solid line shown in FIG. 1 by the moving device.

As illustrated in FIG. 6, the drive timing of exposure differs between the process units 10 for each color, and exposure is performed at two kinds of drive timing: light emission against the photosensitive member 1 of each process unit 10 in accordance with print data and light emission for discharging the photosensitive member 1 to reduce the potential of the surface of the photosensitive member to zero before the photosensitive member 1 stops.

Because the toner images formed on each of the photosensitive members 1 are transferred onto the intermediate transfer belt 15 such that they are superimposed one atop the other, light emission timing in accordance with the print data of exposure (print exposure) for forming electrostatic latent images on the photosensitive members is shifted by a time T11. T11 is a time required for the intermediate transfer belt 15 to travel one section between each of the process units 10 disposed equally spaced (for example, at an interval of 80 mm) along the intermediate transfer belt 15.

As described above with reference to FIG. 2, the time T2 is a required time during which the portion of the photosensitive member 1 that contacts the charging roller 2 arrives at the place of contact with the development device 4. The time T3 is a required time during which the portion of the photosensitive member 1 that contacts the charging roller 2 arrives at the place of contact with the primary transfer roller 5. As described above, the time T4 is the sum of a required time during which the portion of the photosensitive member 1 illuminated with the exposure light Lr arrives at the place of contact with the primary transfer roller 5 and a required time during which the portion of the intermediate transfer belt 15 that contacts the primary transfer roller 5 arrives at the place of contact with the secondary transfer roller 25 (secondary transfer device).

As illustrated in FIG. 6, after an elapse of T3 after driving of the drive motor 60 is stabilized, the high-voltage application device 71 is driven and the primary transfer bias (for example, +1000 V) applied. When the exposure device 3 projects light for discharge at the time tu1, the output of the primary transfer bias is raised. For example, the primary transfer bias of +1200 V is output to reliably discharge the non-image area B2, and the output is stopped when the drive motor 60 starts to stop. Accordingly, the image area B1 and the non-image area B2 of the photosensitive member 1 are electrically discharged before the photosensitive member 1 stops.

T5 refers to a time by which light emission is completed and which corresponds to a time required for the photosensitive member 1 to make one rotation. The secondary transfer bias output is turned on, and light emission for discharge is completed in association with the time te1 at which rotation of the photosensitive member 1 is stopped (i.e., driving of the drive motor 60 is turned off). This light emission for discharge is similar to or the same light emission when printing in black entirely (the surface of the photosensitive member is electrically discharged). This light emission stops when the drive motor 60 stops.

Figure 8:
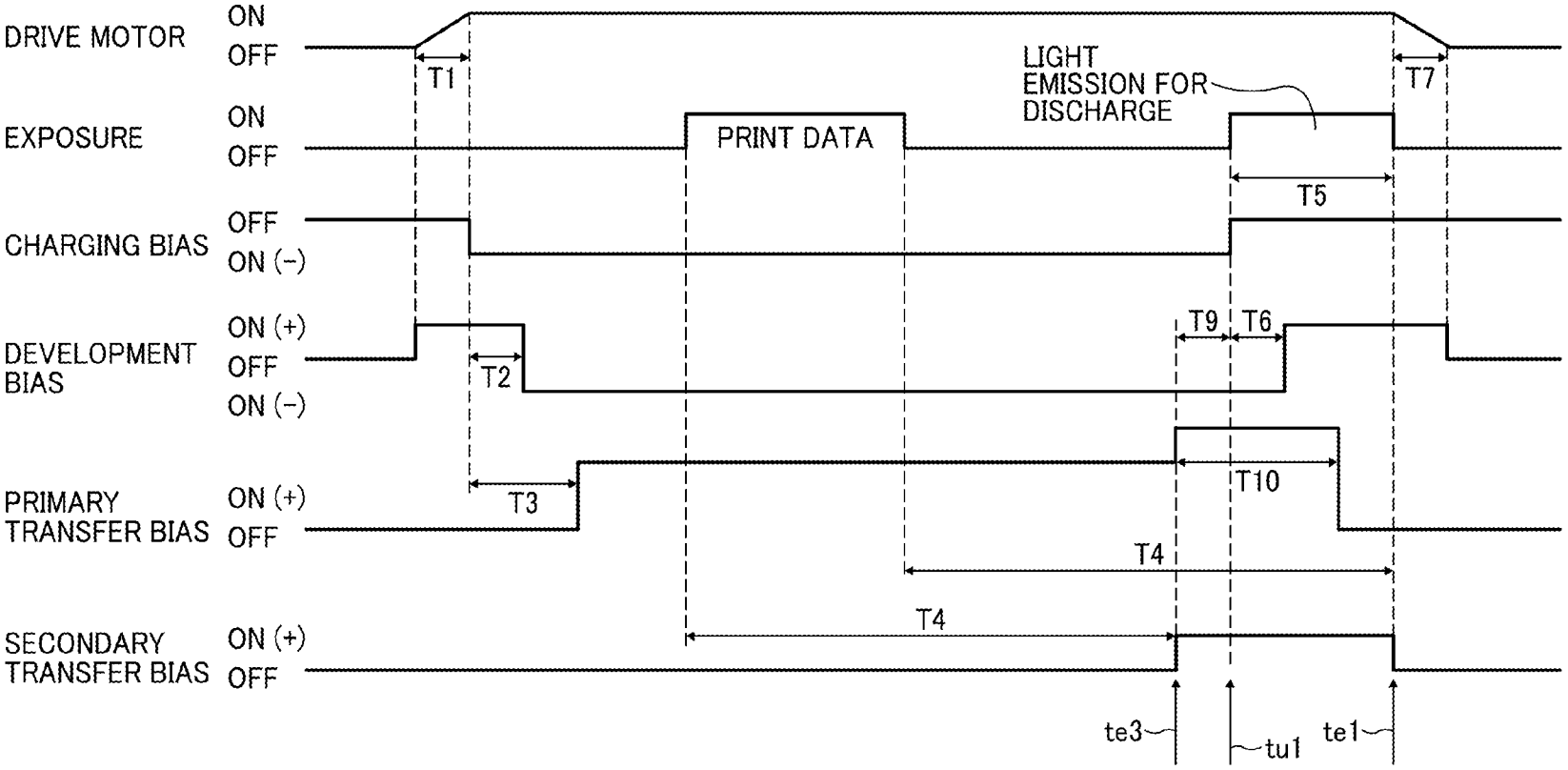
FIG. 8 is a timing diagram showing an operation sequence according to another illustrative embodiment of the present disclosure.

With reference to FIG. 8, a description is provided of another example of application timing of the primary transfer bias (transfer electrical field) used for discharging the photosensitive member 1. In FIG. 2, light emission for discharging the photosensitive member 1 starts at the time tu1 at which the primary transfer bias starts to be applied for electrically discharge. Alternatively, as illustrated in FIG. 8, the primary transfer bias starts to be applied before the time tu1. For example, as illustrated in FIG. 8, the primary transfer bias is applied at a time te3 before the time tu1 at which light emission for discharging the photosensitive member starts. In other words, the primary transfer bias is applied before a time T9 which is defined by a distance between the primary transfer nip to the exposure portion of the photosensitive member divided by a speed. (T9=Distance from the primary transfer nip to the photosensitive member/Speed) More specifically, the time T9 is expressed by L/V (sec), where L is a distance (mm) from the transfer nip to the exposure position and V is a linear velocity (mm/s).

With this configuration, the development potential can be reduced as the discharged portion of the photosensitive member 1 electrically discharged by the primary transfer bias arrives at a development nip opposite the development roller 401 (the development bias has been switched to positive), thereby moving the toner to the photosensitive member 1 and hence preventing background fogging or contamination of the background. With this configuration, the entire area of the photosensitive member 1 in the scanning direction is electrically discharged by the transfer electrical field of the primary transfer device, thereby maintaining the surface potential of the photosensitive member 1 at a proper level and hence preventing undesirable adherence of toner.

The duration of discharging time of the primary transfer bias corresponds to one cycle of the photosensitive member 1 (T10). Since the duration of discharging time of the primary transfer bias is equal to or less than the circumferential length of the photosensitive member 1, a wasteful surface potential of the photosensitive member 1 can be suppressed and the surface of the photosensitive member 1 can be discharged for a proper period of time. Accordingly, the development potential is prevented from increasing, hence preventing undesirable adherence of toner.

Figure 9:
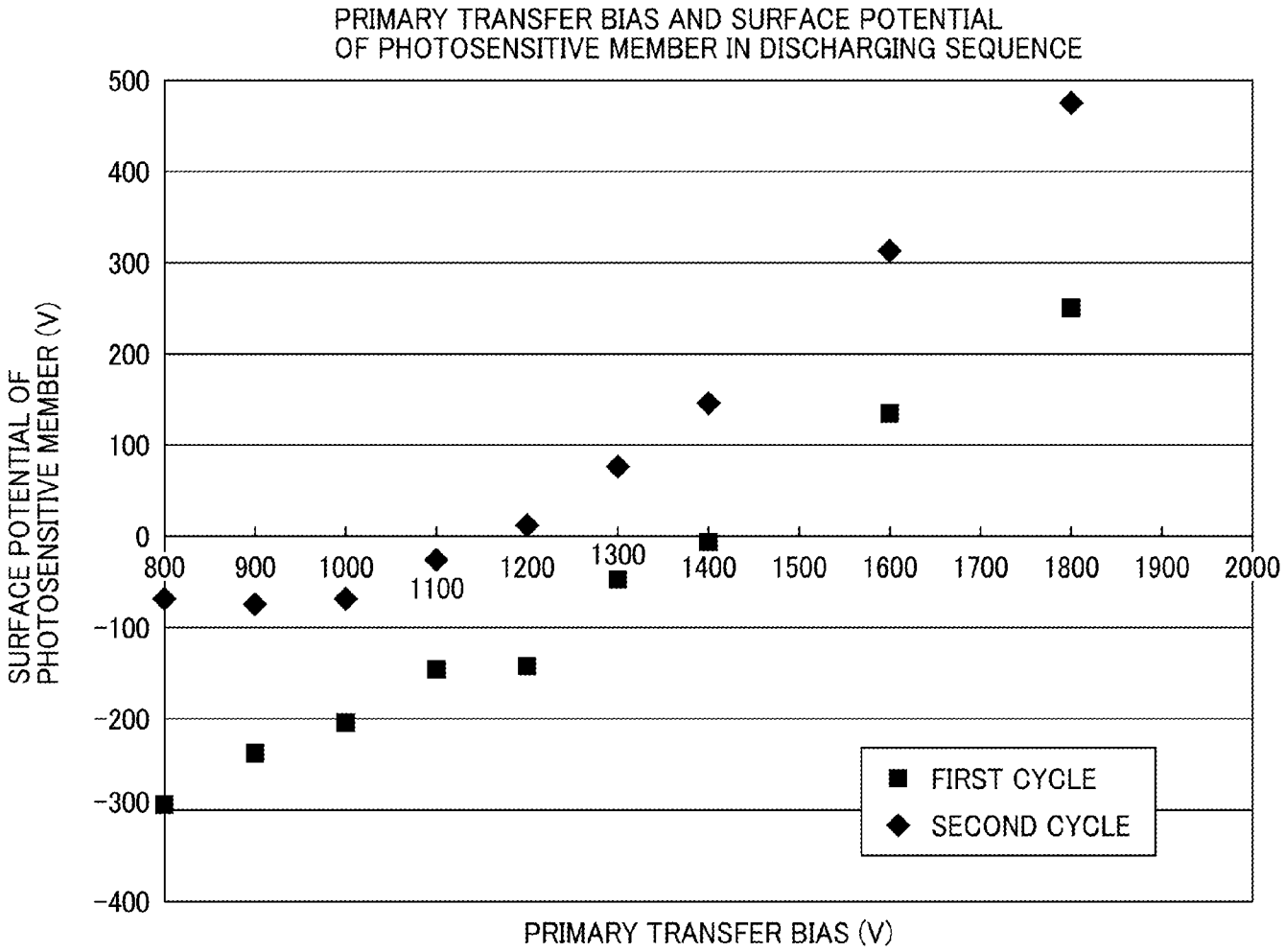
FIG. 9 is a graph showing an example of a correlation between a number of application of a primary transfer bias and the surface potential of the photosensitive member in the discharging sequence according to an illustrative embodiment of the present disclosure.

With reference to FIG. 9, a description is provided of a duration of application of the primary transfer bias (transfer electrical field) used for discharging the photosensitive member 1. The duration of application of the primary transfer bias shown in FIG. 2 corresponds to the time for the photosensitive member 1 to make one rotation.

FIG. 9 shows a correlation between the number of times that the primary transfer bias is applied (duration of application of the primary transfer bias) while the image forming operation is stopped.

When the discharging time (T10 shown in FIG. 8) of the primary transfer bias is relatively long, for example, when the primary transfer bias is applied twice on the photosensitive member 1 (see SECOND CYCLE in FIG. 9), the surface potential of the photosensitive member 1 is positive charged, thereby changing the exposure sensitivity of the photosensitive member 1 and hence resulting in unevenness of image density. In view of the above, the application time (T10) of the transfer electrical field as the primary transfer bias is equal to or less than the time during which the photosensitive member 1 makes one rotation. Accordingly, the surface potential of the photosensitive member 1 is prevented from getting overly discharged and positive charged, and the development potential is prevented from increasing. Preventing the photosensitive member 1 from getting positive charged, for example, maintaining the photosensitive member at a little less than 0V can prevent unevenness of image density. For this reason, preferably, the application time (T10) of the primary transfer bias corresponds to the time during which the photosensitive member 1 makes one rotation.

Figure 10:
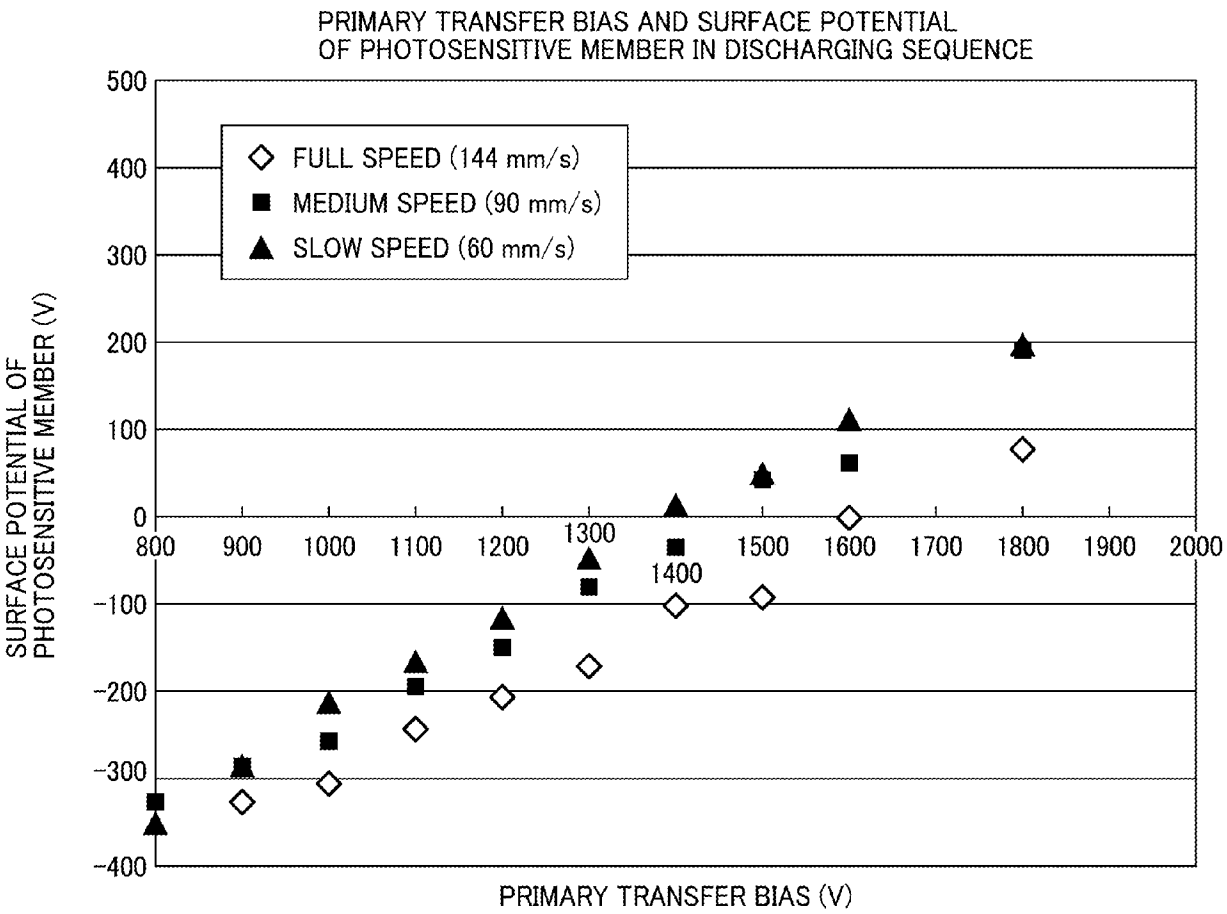
FIG. 10 is a graph showing an example of a correlation between the primary transfer bias and the surface potential of the photosensitive member at different linear velocities of the photosensitive member when the image forming operation stops in the discharging sequence.

Next, with reference to FIG. 10, a description is provided of a correlation between the primary transfer bias and the surface potential of the photosensitive member under different linear velocities of the photosensitive member 1 before the image forming operation stops.

FIG. 10 is a graph showing the correlation between the primary transfer bias and the surface potential of the photosensitive member under different linear velocities (144 mm/s, 90 mm/s, and 60 mm/s) of the photosensitive member 1 before the image forming operation stops.

At the linear velocity of 90 mm/s and at the linear velocity of 60 mm/s, the time period during which the primary transfer bias is applied is longer than that at the linear velocity of 144 mm/s. Therefore, the photosensitive member 1 is discharged more easily. Thus, by making the primary transfer electrical field as the primary transfer bias changeable in accordance with the linear velocity of the photosensitive member 1, an optimum primary transfer bias can be set at each linear velocity, thereby preventing an increase in the development potential and preventing undesirable adherence of toner.

Figure 11:
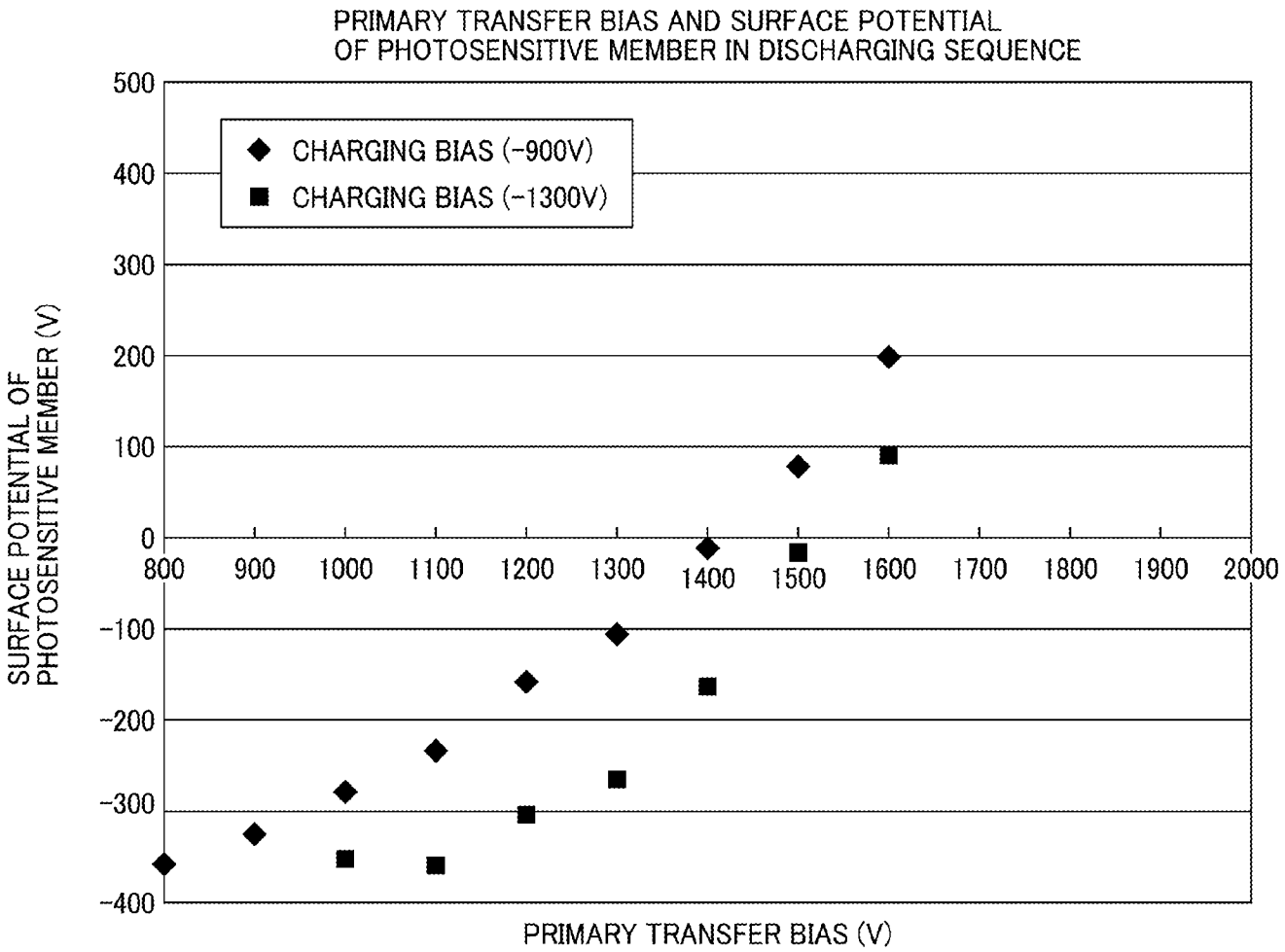
FIG. 11 is a graph showing an example of a correlation between the primary transfer bias and the surface potential of the photosensitive member with different charge biases in the discharging sequence.

With reference to FIG. 11, a description is provided of a correlation between the primary transfer bias and the surface potential of the photosensitive member 1 under different charge biases of the photosensitive member before the image forming operation is stopped.

FIG. 11 is a graph showing an example of a correlation between the primary transfer bias and the surface potential of the photosensitive member 1 with different charging biases of the photosensitive member 1. As understood from FIG. 11, even when the primary transfer bias at the time of image formation is the same, under different charging biases the surface potential of the photosensitive member 1 changes after the photosensitive member 1 is electrically discharged by the primary transfer bias.

In view of the above, the charging bias prior to application of the primary transfer bias is optimized, fluctuation of the surface potential of the photosensitive member is prevented. That is, in order to prevent the surface potential of the photosensitive member 1 from exceeding 0V and getting positive charged, the surface potential of the photosensitive member 1 is maintained at a little less than 0V by the charging bias, which prevents unevenness of image density. With the surface potential of the photosensitive member before application of the primary transfer bias having a specific value, the surface potential of the photosensitive member is prevented from varying, hence reliably discharging the photosensitive member.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a photosensitive member to bear an electrostatic latent image on a surface thereof;

a charging device to apply a charging bias to the surface of the photosensitive member to uniformly charge the surface thereof;

an exposure device to illuminate the surface of the photosensitive member to form the electrostatic latent image, the exposure device being disposed downstream from the charging device in a direction of rotation of the photosensitive member;

a development device to develop with a development bias the electrostatic latent image using a development agent to form a toner image, the development device being disposed downstream from the exposure device in the direction of rotation of the photosensitive member;

a transfer device to transfer the toner image from the photosensitive member onto one of an intermediate transfer member and a recording medium by a transfer electrical field, the transfer device being disposed downstream from the development device in the direction of rotation of the photosensitive member, the transfer device including, a primary transfer device to transfer the toner image from the photosensitive member onto the intermediate transfer member by a primary transfer electrical field, and a secondary transfer device to transfer the toner image from the intermediate transfer member to the recording medium;

a first driving device to rotatably drive one of the photosensitive member and a combination of the photosensitive member and the intermediate transfer member;

a second driving device to rotatably drive the intermediate transfer member and the first driving device that drives the photosensitive member;

a voltage application device to supply a respective predetermined voltage to the charging device, the development device, and the transfer device; and a controller to control the first driving device and the voltage application device, wherein the voltage application device supplies a respective predetermined voltage to the charging device, the development device, and the primary transfer device, and the controller controls the first driving device, the second driving device, and the voltage application device, and both illumination from the exposure device and the primary transfer electrical field electrically discharge the surface of the photosensitive member when the photosensitive member and the intermediate transfer member are stopped.

2. The image forming apparatus according to claim 1, wherein the photosensitive member starts to be electrically discharged at a time at which a trailing edge of the recording medium passes through the secondary transfer device, and after the trailing edge of the recording medium passes through the secondary transfer device the second driving device stops driving the intermediate transfer member.

3. The image forming apparatus according to claim 1, wherein the second driving device stops driving the intermediate transfer member at the same time as the first driving device stops driving the photosensitive member.

4. The image forming apparatus according to claim 1, wherein the first driving device and the second driving device are a common drive source.

5. The image forming apparatus according to claim 1, further comprising;

a cleaning device disposed downstream from the secondary transfer device in a direction of rotation of the intermediate transfer member to clean a surface of the intermediate transfer member.

6. The image forming apparatus according to claim 5, wherein the cleaning device includes a rubber blade.

7. The image forming apparatus according to claim 6, wherein the development agent comprises toner in which silica containing oil is used as an external additive.

8. The image forming apparatus according to claim 1, wherein the primary transfer electrical field is changeable in accordance with a travel distance of the intermediate transfer member and the photosensitive member when the photosensitive member and the intermediate transfer member are stopped.

9. The image forming apparatus according to claim 8, wherein the first driving device is a first driving motor to drive the photosensitive member, and the second driving device is a second driving motor to drive the intermediate transfer member, and wherein the travel distance is obtained from a number of rotation per unit time of the first motor and a number of rotation per unit time of the second motor.

10. The image forming apparatus according to claim 1, wherein the primary transfer electrical field is changeable in accordance with environment conditions.

11. The image forming apparatus according to claim 1, wherein the surface of the photosensitive member is not positive charged after being electrically discharged by the primary transfer electrical field.

12. The image forming apparatus according to claim 1, wherein a time during which the primary transfer electrical field is applied coincides with a time for the photosensitive member to make one rotation.

13. The image forming apparatus according to claim 1, wherein the primary transfer electrical field is a primary transfer bias and changeable in accordance with a linear velocity of the photosensitive member.

14. The image forming apparatus according to claim 1, wherein the primary transfer electrical field is changeable in accordance the charging bias.

15. The image forming apparatus according to claim 1, wherein the charging bias is set to obtain a predetermined level of the surface potential of the photosensitive member prior to application of the primary transfer electrical field.

16. The image forming apparatus according to claim 1, wherein a discharging time during which the transfer electrical field electrically discharges the photosensitive member is equal to or less than a circumferential length of the photosensitive member.

17. The image forming apparatus according to claim 1, wherein the transfer electrical field is applied prior to a time L/V seconds before exposure, where L is a distance (mm) from a transfer nip opposite to the transfer device to an exposure position and V is a linear velocity (mm/s) of the photosensitive member.

18. An image forming apparatus comprising:

a photosensitive member to bear an electrostatic latent image on a surface thereof;

a charging device to apply a charging bias to the surface of the photosensitive member to uniformly charge the surface thereof;

an exposure device to illuminate the surface of the photosensitive member to form the electrostatic latent image, the exposure device being disposed downstream from the charging device in a direction of rotation of the photosensitive member, a development device to develop with a development bias the electrostatic latent image using a development agent to form a toner image, the development device being disposed downstream from the exposure device in the direction of rotation of the photosensitive member;

a transfer device to transfer the toner image from the photosensitive member onto one of an intermediate transfer member and a recording medium by a transfer electrical field, the transfer device being disposed downstream from the development device in the direction of rotation of the photosensitive member;

a first driving device to rotatably drive one of the photosensitive member and a combination of the photosensitive member and the intermediate transfer member;

a voltage application device to supply a respective predetermined voltage to the charging device, the development device, and the transfer device; and a controller to control the first driving device and the voltage application device, wherein both illumination from the exposure device and the transfer electrical field discharge the surface of the photosensitive member when the photosensitive member is stopped, and when one of the photosensitive member and the combination of the photosensitive member and the intermediate transfer member is stopped, the voltage application device reverses a polarity of the development voltage to an opposite polarity to the polarity during development.

19. An image forming apparatus comprising:

a photosensitive member to bear an electrostatic latent image on a surface thereof;

a charging device to apply a charging bias to the surface of the photosensitive member to uniformly charge the surface thereof;

an exposure device to illuminate the surface of the photosensitive member to form the electrostatic latent image, the exposure device being disposed downstream from the charging device in a direction of rotation of the photosensitive member;

a development device to develop with a development bias the electrostatic latent image using a development agent to form a toner image, the development device being disposed downstream from the exposure device in the direction of rotation of the photosensitive member;

a transfer device to transfer the toner image from the photosensitive member onto one of an intermediate transfer member and a recording medium by a transfer electrical field, the transfer device being disposed downstream from the development device in the direction of rotation of the photosensitive member;

a first driving device to rotatably drive one of the photosensitive member and a combination of the photosensitive member and the intermediate transfer member;

a voltage application device to supply a respective predetermined voltage to the charging device, the development device, and the transfer device; and a controller to control the first driving device and the voltage application device, wherein both illumination from the exposure device and the transfer electrical field discharge the surface of the photosensitive member when the photosensitive member is stopped, and when one of the photosensitive member and the combination of the photosensitive member and the intermediate transfer member is stopped, the voltage application device reduces a charging voltage of the charging device to a level less than that during development.

* * * * *